US008267492B2

(12) United States Patent
Lucas et al.

(10) Patent No.: US 8,267,492 B2
(45) Date of Patent: Sep. 18, 2012

(54) METHOD OF ROUTING UTILITIES THROUGH AN ARTICULATED HINGE

(75) Inventors: Alan S. Lucas, Evansville, IN (US); Harish Kulkarni, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 124 days.

(21) Appl. No.: 12/437,089

(22) Filed: May 7, 2009

(65) Prior Publication Data

US 2010/0283366 A1 Nov. 11, 2010

(51) Int. Cl.
*A47B 96/04* (2006.01)

(52) U.S. Cl. ..... 312/405; 49/333; 49/334; 49/335; 16/354; 16/386

(58) Field of Classification Search ..... 312/405.1, 312/405, 321.5, 292, 271, 273, 274, 319.5–319.8, 312/326, 329, 334.27, 401, 223.6; 16/246, 16/237, 238, 339, 240, 245, 341, 344, 347, 16/351, 363, 387, 361, 364, 354, 386; 69/449, 69/454, 390, 338, 339, 389; 62/389, 440; 74/490.01–490.06; 475/331; 49/333, 334, 49/335

See application file for complete search history.

(56) References Cited

U.S. PATENT DOCUMENTS

| | | | | | |
|---|---|---|---|---|---|
| 283,416 | A | | 8/1883 | Pattison | |
| 1,472,457 | A | * | 10/1923 | Brown | 49/257 |
| 2,067,042 | A | | 1/1937 | Bloom | |
| 2,078,815 | A | | 4/1937 | Segar | |
| 2,206,739 | A | | 7/1940 | Brogren et al. | |
| 2,516,935 | A | * | 8/1950 | Weaver | 16/50 |
| 2,665,414 | A | * | 1/1954 | Hubacker et al. | 439/31 |
| 2,890,476 | A | | 6/1959 | Lustig | |
| 2,975,013 | A | | 3/1961 | Wallace et al. | |
| 3,016,261 | A | | 1/1962 | Tatter | |
| 3,422,487 | A | * | 1/1969 | Dickinson et al. | 16/354 |
| 3,429,140 | A | * | 2/1969 | White | 62/339 |
| 3,842,386 | A | * | 10/1974 | Suska | 439/31 |
| 3,908,394 | A | * | 9/1975 | Jacobus | 62/339 |
| 4,211,451 | A | * | 7/1980 | Shephard | 297/362 |
| 4,284,861 | A | * | 8/1981 | Senften | 200/61.7 |
| 4,516,813 | A | | 5/1985 | Sekerich | |
| 4,543,800 | A | * | 10/1985 | Mawby et al. | 62/339 |
| 4,584,738 | A | | 4/1986 | Lautenschlager | |
| 4,609,234 | A | | 9/1986 | Naniwa et al. | |
| 4,765,027 | A | | 8/1988 | Andric | |
| 4,774,740 | A | * | 10/1988 | Gidseg et al. | 16/344 |
| 4,821,530 | A | * | 4/1989 | Ledbetter | 62/332 |
| 4,979,265 | A | * | 12/1990 | Grass | 16/291 |
| 5,001,810 | A | * | 3/1991 | Baer | 16/302 |
| 5,040,857 | A | | 8/1991 | Mandel et al. | |
| 5,102,084 | A | * | 4/1992 | Park | 248/286.1 |
| 5,221,239 | A | * | 6/1993 | Catlett | 475/342 |
| 5,263,509 | A | * | 11/1993 | Cherry et al. | 137/343 |
| 5,321,870 | A | * | 6/1994 | Wada et al. | 16/300 |
| 5,462,498 | A | * | 10/1995 | Lindblad | 475/342 |
| 5,500,985 | A | | 3/1996 | Klueger | |

(Continued)

*Primary Examiner* — Darnell Jayne
*Assistant Examiner* — Hiwot Tefera
(74) *Attorney, Agent, or Firm* — Kirk W. Goodwin; McKee Vorhees & Sease

(57) ABSTRACT

An articulated hinge allowing non-circular motion of a refrigerator door and having a mechanism for transmitting utilities through the hinge is provided. A support rod for preventing torsional deformation of a refrigerator door adapted to carry utilities to an in-door dispenser is also provided.

7 Claims, 5 Drawing Sheets

U.S. PATENT DOCUMENTS 5,606,773 A * 3/1997 Shappell ..... 16/298
5,687,509 A * 11/1997 Barroero et al. ..... 49/386
5,787,724 A * 8/1998 Pohl et al. ..... 62/389
5,941,619 A * 8/1999 Stieben et al. ..... 312/223.6
6,191,937 B1 2/2001 Bang
6,205,617 B1 * 3/2001 Held et al. ..... 16/246
6,209,265 B1 * 4/2001 Banicevic et al. ..... 49/501
6,241,300 B1 * 6/2001 Suzuki ..... 296/37.8
6,318,824 B1 11/2001 LaGrotta et al.
6,519,812 B2 2/2003 Ko et al.
6,591,454 B2 7/2003 Brustle
6,694,674 B2 * 2/2004 Son ..... 49/335
6,925,684 B2 * 8/2005 Kang et al. ..... 16/264
6,968,598 B2 * 11/2005 Becker et al. ..... 16/349
7,127,778 B2 * 10/2006 Salice ..... 16/354
7,207,087 B2 4/2007 Salice
7,266,963 B2 * 9/2007 Lee ..... 62/259.1
7,269,968 B2 * 9/2007 Harder et al. ..... 62/389
7,322,209 B2 * 1/2008 Hwang et al. ..... 62/449
7,328,484 B2 * 2/2008 Salice ..... 16/354
7,555,815 B2 * 7/2009 Tate et al. ..... 16/309
7,980,151 B2 * 7/2011 Hormann ..... 74/421 A
2003/0073537 A1 * 4/2003 Lloyd ..... 475/331
2003/0172591 A1 * 9/2003 Labarre ..... 49/248
2004/0034968 A1 * 2/2004 Williams ..... 16/354
2004/0182104 A1 * 9/2004 Choi ..... 62/389
2005/0217308 A1 * 10/2005 Hwang et al. ..... 62/440
2005/0258724 A1 * 11/2005 Hwa Kim ..... 312/405
2006/0064846 A1 * 3/2006 Espindola et al. ..... 16/223
2006/0080991 A1 * 4/2006 An et al. ..... 62/389
2006/0226751 A1 * 10/2006 Park ..... 312/405.1
2006/0232176 A1 10/2006 Kim et al.
2007/0099747 A1 * 5/2007 Ando et al. ..... 475/331
2007/0144072 A1 * 6/2007 Hansel et al. ..... 49/246
2007/0204647 A1 * 9/2007 Puthiyaveetil et al. ..... 62/389
2007/0204648 A1 * 9/2007 Smale et al. ..... 62/389
2008/0103016 A1 * 5/2008 Nagy et al. ..... 475/331
2009/0229297 A1 * 9/2009 Allard et al. ..... 62/449
2010/0033067 A1 * 2/2010 Kim et al. ..... 312/236
2010/0231111 A1 * 9/2010 Kang et al. ..... 312/405
2011/0048060 A1 * 3/2011 Kim et al. ..... 62/449

* cited by examiner

METHOD OF ROUTING UTILITIES THROUGH AN ARTICULATED HINGE

BACKGROUND OF THE INVENTION

In a refrigerator having a door mounted ice or water dispenser there is a need to transfer utilities, such as water or high or low voltage electricity, from the refrigerator cabinet to the door. In the prior art, utilities are transferred to the door from the refrigerator cabinet in a number of ways, such as through the hinge, through the edge of the door, or adjacent to the hinge. However, the use of articulated hinges which permit the door to open in a non-circular path makes these traditional routing options ineffective or less desirable.

Therefore, a need has been identified in the art to provide a means for routing utilities from a refrigerator cabinet through an articulated hinge and to a door mounted dispenser.

Another recognized area of concern is the potential for a refrigerator door to twist, bend, or otherwise deform as the door is opened on articulated hinges. Therefore, a further need has been identified in the art to provide increased stability for a refrigerator door having articulated hinges.

There is a further concern in refrigerator manufacturing to route utilities to the dispenser from the interface point between the refrigerator cabinet and door. Therefore, a need has been identified in the art to provide a means for routing utilities within the refrigerator door to the dispenser.

BRIEF SUMMARY OF THE INVENTION

The present invention is directed to transferring utilities from a refrigerator cabinet through an articulated hinge to a refrigerator door with an in-door dispenser. Additionally, an apparatus for routing utilities within the refrigerator door and providing support against torsion forces on the door during opening is disclosed.

According to one preferred embodiment of the present invention, the articulated hinge has a hinge pin attached to the door, the hinge pin having a passage through which utilities may be routed.

According to an alternative embodiment of the present invention, a support rod extends between the top hinge and the bottom hinge, the support rod having a hollow center for carrying utilities towards the door mounted dispenser.

DETAILED DESCRIPTION OF THE PREFERRED EMBODIMENT

The invention relates generally to an improved hinge for use with a refrigerator, the hinge designed to open the refrigerator door in a non-circular path and having features for transmitting utilities through the hinge to a dispenser mounted in the door.

Figure 1A:
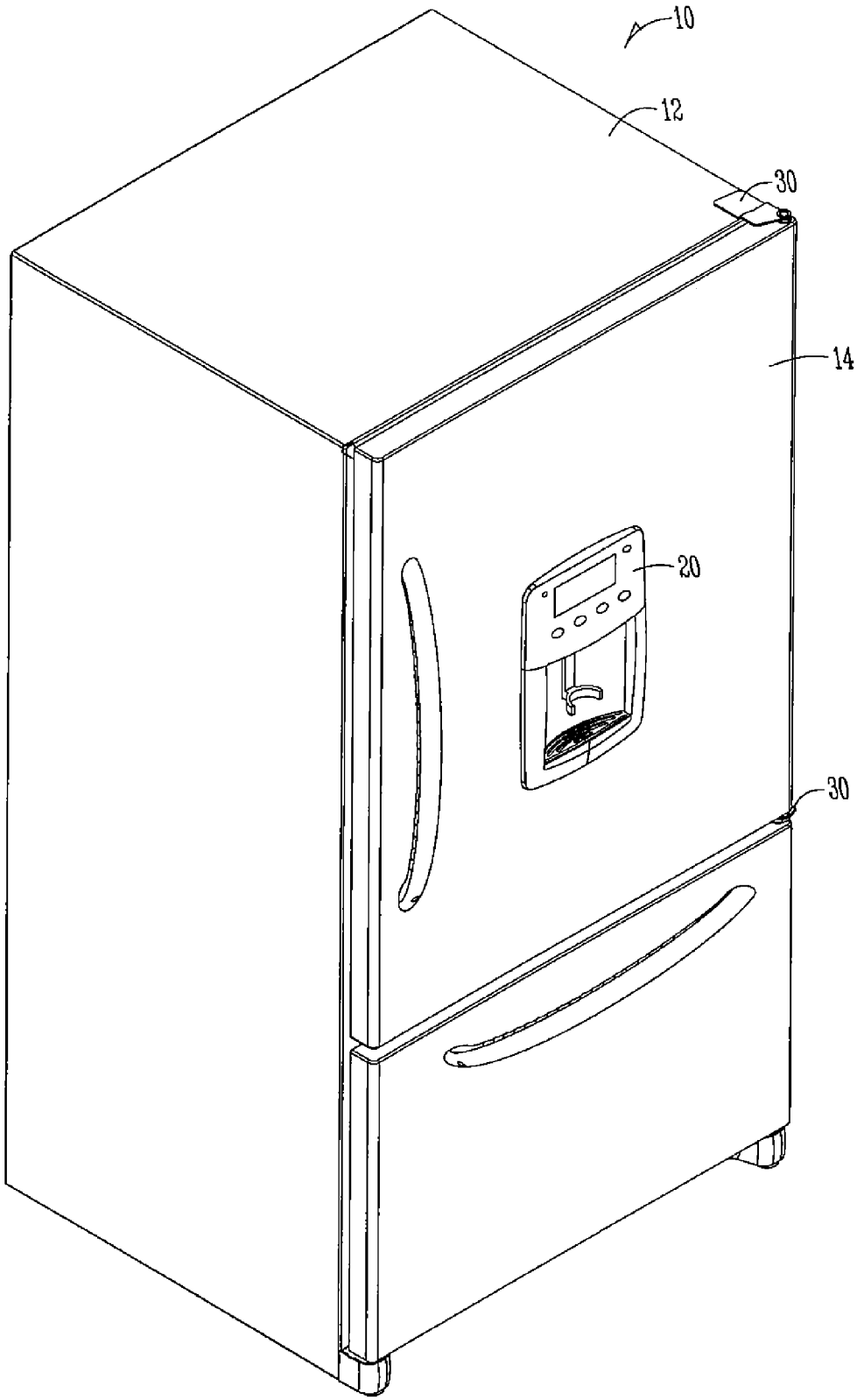
FIG. 1A is a perspective view of a refrigerator having a door mounted dispenser and an articulated hinge.

FIG. 1A shows a refrigerator 10 with a refrigerated compartment 12 attached to a door 14 with a hinge 30 located at the top and bottom of the door 14. A dispenser 20 is mounted at a convenient height for a consumer, although the height may vary according to design requirements. The dispenser 20 is preferably designed to selectively dispense ice and water, although other products may be dispensed through the dispenser as is generally known in the art.

Figure 1B:
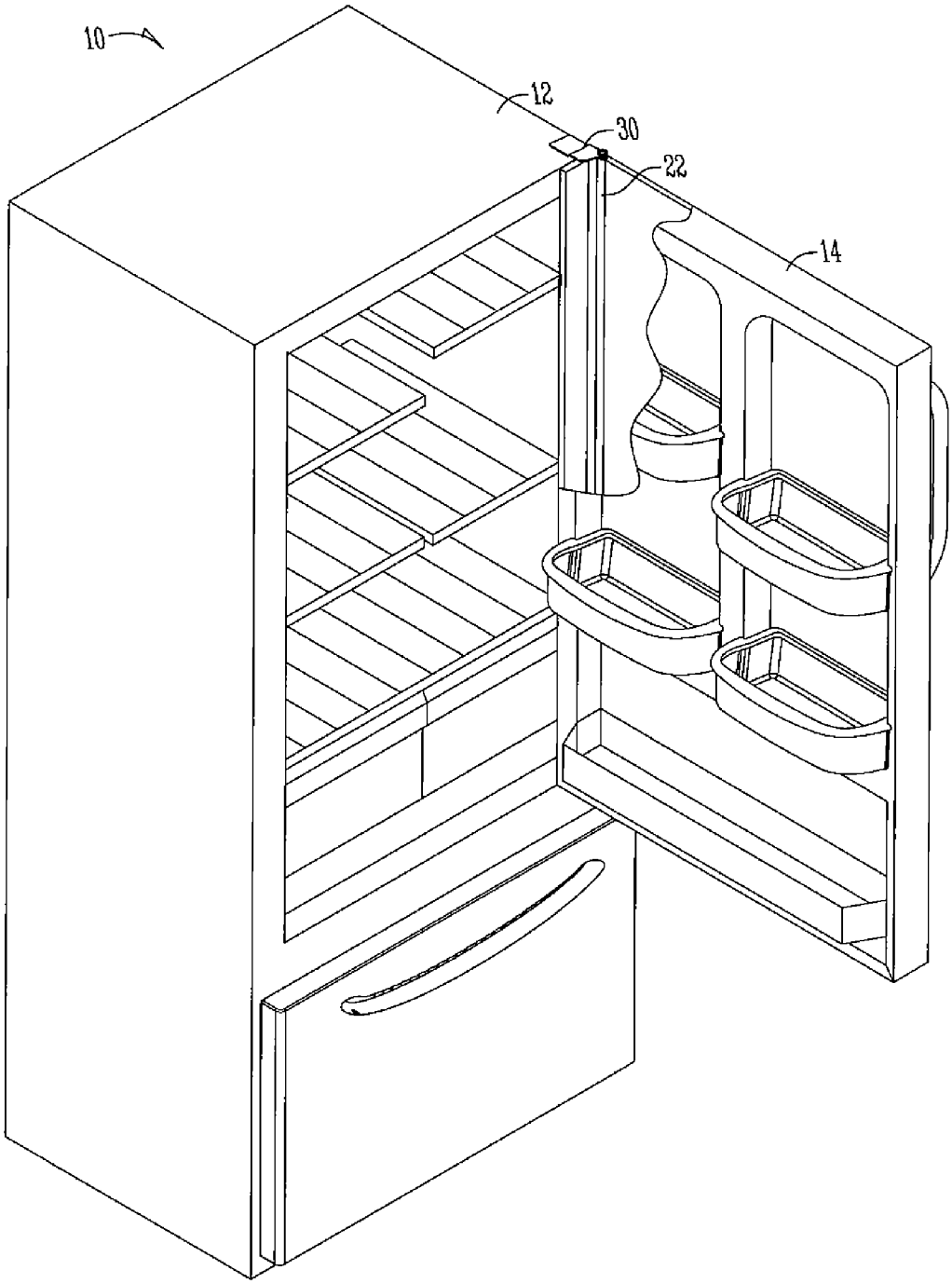
FIG. 1B shows a refrigerator in a fully opened position.

FIG. 1B shows the refrigerator door 14 in a fully opened position, providing access to the refrigerated compartment 12. As can be appreciated, the hinges 30 allow the door to be opened in a non-circular path, thereby allowing the refrigerator 10 to be mounted generally flush to and with no obvious gap between adjacent cabinets. The refrigerator as shown in FIGS. 1A and 1B is a top mount refrigerator 10 with a single door 14. However, it should be appreciated by those skilled in the art that the present invention may be utilized with a side-by-side, bottom mount, or other type of refrigerator 10. Additionally, the refrigerated compartment 12 may feature a single door, a pair of French doors, or any configuration generally known in the art.

Figure 2A:
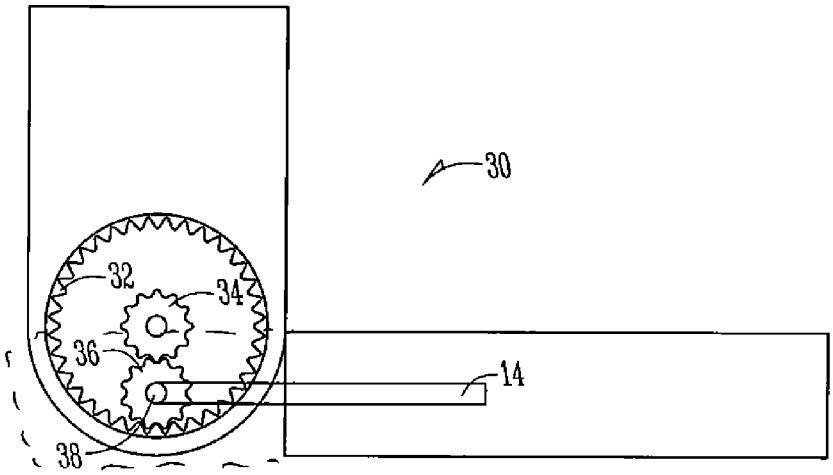
FIG. 2A shows a cutaway view of the hinge demonstrating one embodiment of the present invention.
Figure 2B:
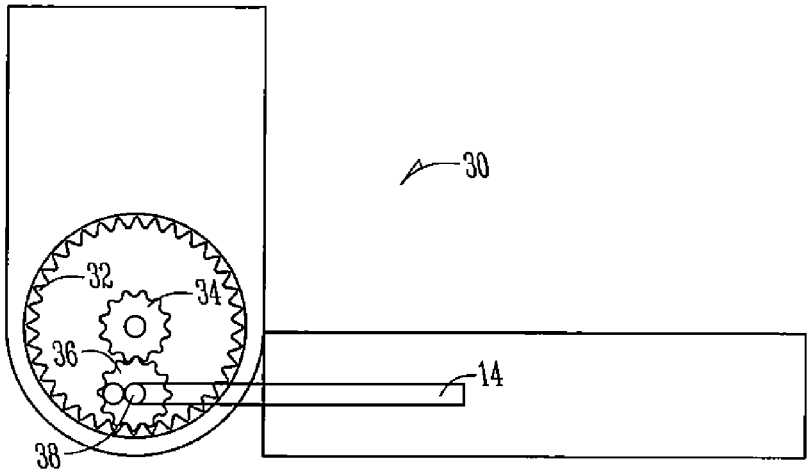
FIG. 2B shows a cutaway view of the hinge showing an alternative embodiment of the present invention.
Figure 2C:
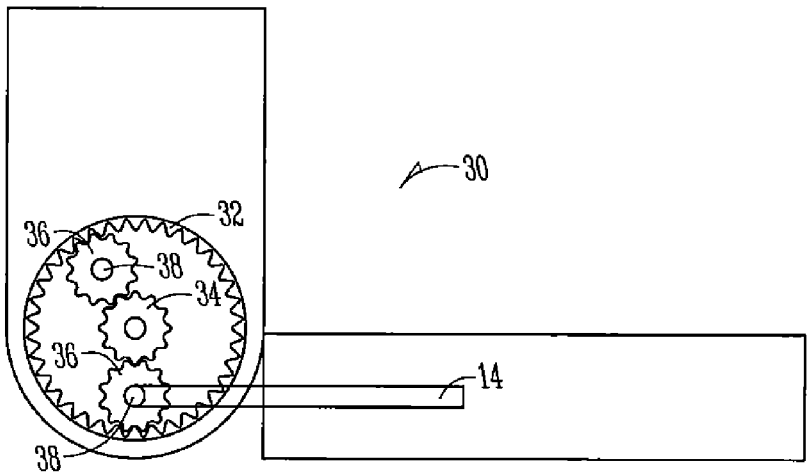
FIG. 2C shows a cutaway view of the hinge showing an alternative embodiment of the present invention.

FIGS. 2A-C show a variety of alternative embodiments of the present invention. Generally, the hinge 30 comprises an annulus 32, a sun gear 34, one or more planetary gears 36, and one or more hinge pins 38, at least one of the hinge pins 38 having a passage 40. The door 14 is secured to the hinge pin 38 such that rotational motion of the door 14 is translated to the planetary gear 36. The combination of the annulus 32 and sun gear 34 translate the rotational motion of the planet gear 36 into translational motion about an arc centered on the sun gear 34.

Alternatively, as shown in FIG. 2B, the planet gear 36 may include more than one hinge pin 38. Because the door 14 does not rotate independent of planet gear 36, both hinge pins 38 could be used to route utilities from the refrigerator cabinet 12 through the hinge 30.

As shown in FIG. 2C, a number of planet gears 36 may be used, each having a hinge pin 38. The design of the planetary gear system requires that the distance between the two planet gears 36, and therefore their hinge pins 38, remain the same. Therefore, utilities may be routed through either hinge pin 38 without having to accommodate a change in distance between the two hinge pins 38.

Figure 3:
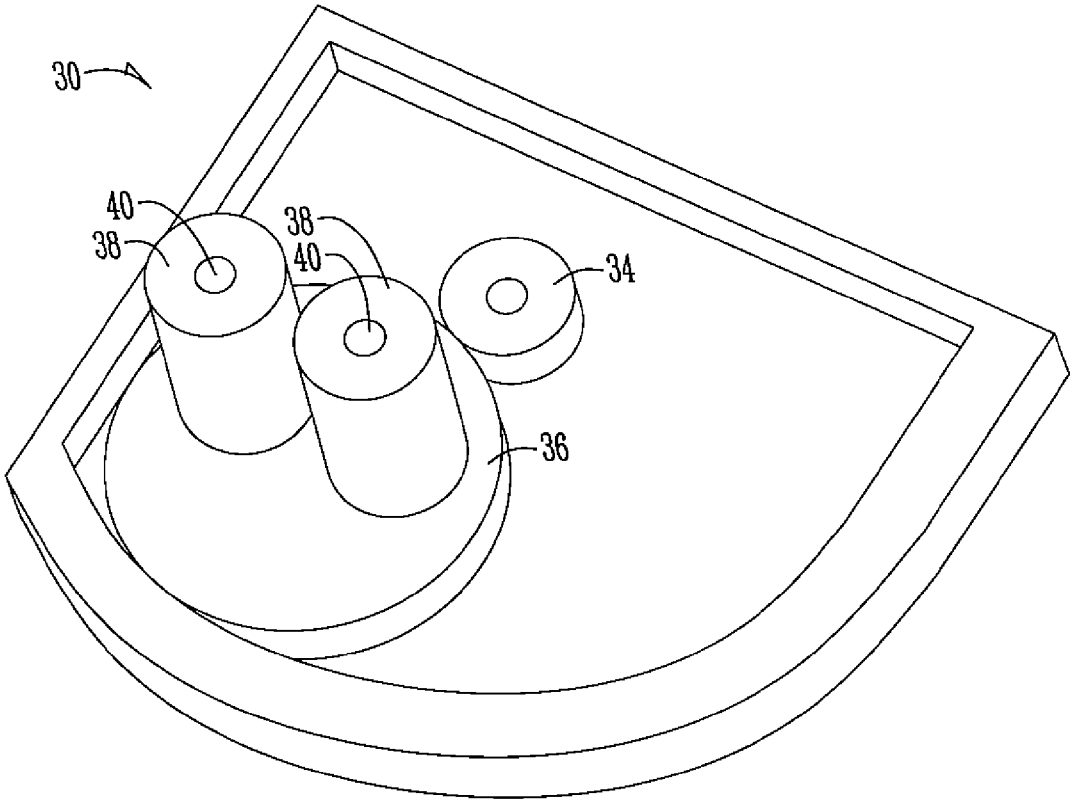
FIG. 3 is an isometric view of the hinge according to the preferred embodiment of the present invention.

As shown in FIG. 3, the annulus 32 of the hinge 30 may be a partial gear, allowing the refrigerator door 14 to be open only to a predetermined angle. As shown in FIGS. 2A-2C, the annulus 32 may be a complete gear with one or more planet gears 36, each having one or more hinge pins 38 for routing utilities to the door 14.

FIG. 3 is a perspective view of the refrigerator hinge 30, showing the hinge pin 38 and passage 40. The particular embodiment shown in FIG. 3 shows passage 40 as a through hole in hinge pin 38. According to this preferred embodiment, a utility line may be passed through the passage 40 without modification or additional design accommodations. However, hinge pin 38 and passage 40 may take several forms. For example, hinge pin 38 need not be a cylinder, but may be shaped to inhibit rotation of the door 14 about the hinge pin 38. Hinge pin 38 may also be keyed so as to aid in alignment of the planet gear 36 to the door 14 during assembly. Additionally, hinge pin 38 may include geometry for attaching utility supply lines, for example hinge pin 38 may be threaded to accommodate a plumbing fixture. Hinge pin 38 may also include latches or other geometry for receiving a connection for utility transfer. Passage 40 may include functional elements, such as an electrical socket for receiving electrical lines, or a water tight fixture to which water supply lines may be attached.

Additionally, not all utilities supplied to the in-door dispenser 20 need be passed through the hinge 30 or the hinge pin 38. For example, because the distance between the sun gear 34 and the planet gear 36 remains constant, utilities may be passed through the sun gear 34 or other geometry on the sun gear 34. If multiple planet gears 36 are included, the door 14 may be mounted to only one planet gear 36. However, because the distance between any two planet gears 36 is constant, utilities may be routed through one planet gear 36 to the door 14 mounted on another planet gear 36. Additionally, utilities may be passed outside of the hinge, with the utilities having sufficient slack to allow the refrigerator door 14 to fully open.

Figure 4:
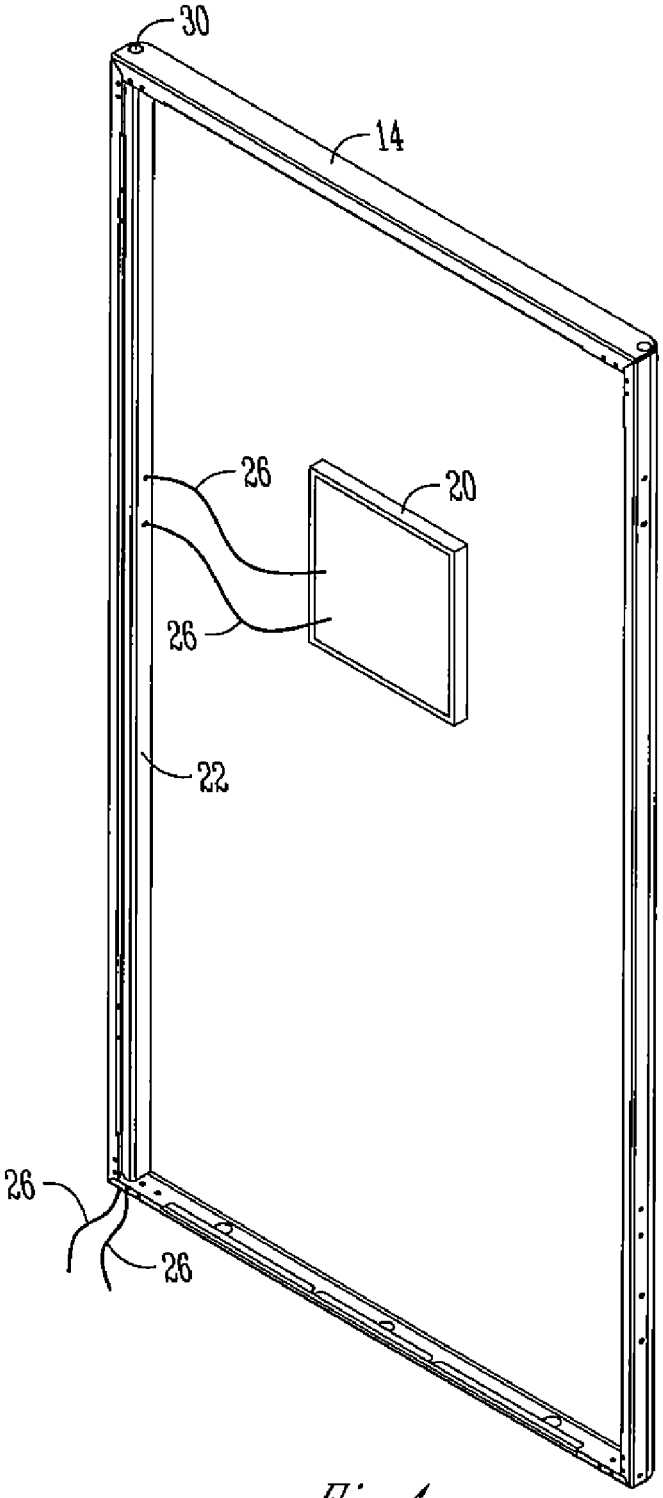
FIG. 4 is a cutaway view of the refrigerator door according to one embodiment of the present invention.

As shown in FIG. 4, the refrigerator door 14 may also include a support rod 22 for providing resistance against torsion and other bending forces on the door 14. Preferably this support rod 22 extends between two hinges 30 located at the top and bottom of the refrigerator door 14. However, the support rod 22 may be placed elsewhere in the refrigerator, or a plurality of support rods may be placed throughout the refrigerator door 14 according to design and functional requirements. Also as shown in FIG. 4, the support rod 22 may be hollow for receiving utility conduits 26 from the hinge 30 and carrying them towards the dispenser 20. The support rod 22 may feature one or more openings 24 for allowing the conduits 26 to pass out of the support rod 22. According to the preferred embodiment, the conduits 26 travel from the refrigerated compartment 12 through the hinge 30 and into the hollow support rod 22, exiting at the opening 24 and continuing to the dispenser 20. However, additional features may be included on the refrigerator door 14, including but not limited to a docking station, an electrical outlet, a digital readout, lighting, or any other type of fixture, dispenser, appliance commonly known in the art.

According to the preferred embodiment of the present invention, utilities such as water, low voltage electricity or high voltage electricity pass through the hinge 30 to the dispenser 20. Additional utilities may also be passed through the hinge 30 according to design requirements. Such utilities include, but are not limited to, a liquid return line, a liquid additive, pressurized air or other gas, or any utility required to operate a door mounted appliance as known in the art.

The above described embodiments are for illustrative purposes only and do not limit the scope of the claimed invention. The invention is only to be limited by the claims of the patent.

What is claimed is:

1. A hinge connecting a cabinet and a door of a refrigerator, the hinge comprising:

an annulus operatively attached to said cabinet;

a sun gear mounted about a center of the annulus;

a first planet gear engaging said sun gear and annulus, having a first hinge pin attached to said door, said first hinge pin having a passage through which at least one utility is routed, and a second planet gear engaging the sun gear and annulus, said second planet gear having a second hinge pin operatively attached to said door, said second hinge pin having a passage through which at least one utility is routed;

said first planet gear and said second planet gear maintaining a constant distance between one another.

2. The hinge of claim 1 whereby said first hinge pin and said second hinge pin carry high and low voltage electric current.

3. The hinge of claim 1 whereby said first hinge pin carries electrical current and said second hinge pin carries water.

4. The hinge of claim 1 whereby said first planet gear comprises a second hinge pin, said second hinge pin having a passage through which at least one utility is routed.

5. The hinge of claim 4 whereby said first hinge pin and said second hinge pin of the first planet gear carry high and low voltage electric current.

6. The hinge of claim 4 whereby said first hinge pin carries electrical current and said second hinge pin of the first planet gear carries water.

7. A refrigerator comprising:

a cabinet having at least one refrigeration compartment;

a door providing access to the refrigeration compartment;

a hinge connecting the cabinet and the door, the hinge comprising;

(a) an annulus operatively attached to said cabinet;

(b) a sun gear mounted about a center of the annulus;

(c) a first planet gear engaging said sun gear and annulus, having a first hinge pin attached to said door, said first hinge pin having a passage through which at least one utility is routed, and a second planet gear engaging the sun gear and annulus, said second planet gear having a second hinge pin operatively attached to said door, said second hinge pin having a passage through which at least one utility is routed;

(d) said first planet gear and said second planet gear maintaining a constant distance between one another.

* * * * *

UNITED STATES PATENT AND TRADEMARK OFFICE

CERTIFICATE OF CORRECTION

PATENT NO. : 8,267,492 B2
APPLICATION NO. : 12/437089
DATED : September 18, 2012
INVENTOR(S) : Alan S. Lucas et al.

It is certified that error appears in the above-identified patent and that said Letters Patent is hereby corrected as shown below:

Col. 4, lines 30 - 46, Claim 7: "A refrigerator comprising: a cabinet having at least one refrigeration compartment; a door providing access to the refrigeration compartment; a hinge connecting the cabinet and the door, the hinge comprising; (a) an annulus operatively attached to said cabinet; (b) a sun gear mounted about a center of the annulus; (c) a first planet gear engaging said sun gear and annulus, having a first hinge pin attached to said door, said first hinge pin having a passage through which at least one utility is routed, and a second planet gear engaging the sun gear and annulus, said second planet gear having a second hinge pin operatively attached to said door, said second hinge pin having a passage through which at least one utility is routed; (d) said first planet gear and said second planet gear maintaining a constant distance between one another." - should be Claim 7: -- A refrigerator comprising: a cabinet having at least one refrigeration compartment; a door providing access to the refrigeration compartment; a hinge connecting the cabinet and the door, the hinge comprising: (a) an annulus operatively attached to said cabinet; (b) a sun gear mounted about a center of the annulus; (c) a first planet gear engaging said sun gear and annulus, having a first hinge pin attached to said door, said first hinge pin having a passage through which at least one utility is routed, and a second planet gear engaging the sun gear and annulus, said second planet gear having a second hinge pin operatively attached to said door, said second hinge pin having a passage through which at least one utility is routed; (d) said first planet gear and said second planet gear maintaining a constant distance between one another. --

Signed and Sealed this
Eighteenth Day of December, 2012

David J. Kappos

David J. Kappos
*Director of the United States Patent and Trademark Office*